US012326004B2

(12) United States Patent
Toca et al.

(10) Patent No.: US 12,326,004 B2
(45) Date of Patent: Jun. 10, 2025

(54) TILE-SETTING SNAP-CLIP LIPPAGE CONTROL

(71) Applicant: DTM INNOVATIONS LLC, Metairie, LA (US)

(72) Inventors: Roland Toca, New Orleans, LA (US); Michele Volponi, Metairie, LA (US); Darrin Godbold, Metairie, LA (US)

(73) Assignee: DTM INNOVATIONS LLC, Metairie, LA (US)

( * ) Notice: Subject to any disclaimer, the term of this patent is extended or adjusted under 35 U.S.C. 154(b) by 248 days.

(21) Appl. No.: 18/141,241

(22) Filed: Apr. 28, 2023

(65) Prior Publication Data

US 2024/0360683 A1 Oct. 31, 2024

(51) Int. Cl.
*E04F 21/00* (2006.01)

(52) U.S. Cl.
CPC ..... *E04F 21/0092* (2013.01)

(58) Field of Classification Search
CPC ... E04F 21/0092; E04F 21/22; E04F 21/1844; E04F 21/1877; E04F 13/0892; E04F 15/0205
See application file for complete search history.

(56) References Cited

U.S. PATENT DOCUMENTS 7,861,487 B2 1/2011 Kufner et al.
7,992,354 B2 8/2011 Doda, Jr.
8,079,199 B1 12/2011 Kufner et al.
8,181,420 B2 5/2012 Torrents I Comas
8,429,878 B1 4/2013 Hoffman et al.
8,689,522 B2 4/2014 Hoffman et al.
8,820,031 B2 9/2014 Kufner et al.
(Continued)

FOREIGN PATENT DOCUMENTS

EP 2549030 A2 11/2014
WO WO2018052331 A1 3/2018

OTHER PUBLICATIONS

Rubi, "New Delta Level System," https://www.rubi.com/en/blog/new-delta-level-system-small-improvements-that-make-a-good-product-great/ (last accessed May 25, 2022).
(Continued)

*Primary Examiner* — Babajide A Demuren
(74) *Attorney, Agent, or Firm* — KEATY LAW FIRM LLC; Thomas S. Keaty

(57) ABSTRACT

A tile-setting snap-clip lippage control system and method for tiles set with mortar as floors or walls on prepared surfaces, providing tab-and-clip pairs with a footed tab lower unit having a footplate connected by a bending neck, a multi-tapered descending portion having a thicker center, tapering base, tapering sides, and a clip mount, and a snap clip upper unit for removable attachment to the footed tab through a tab mount, having a clip body with snap posts and clip ledges, and having two snap flaps mounted through flap hinges, each with a snap hole to engage with a snap post, a flap ledge to engage with a clip ledge, and a flap tooth to engage with the underside of a flap hinge. Two adjacent tiles are held with compressive force between the footplate and one of the snap flaps during curing of the mortar. The footed tab is then removed by lateral striking, shearing at the bending neck, leaving only the encapsulated footplate.

15 Claims, 5 Drawing Sheets

(56) References Cited

U.S. PATENT DOCUMENTS

| | | | | |
|---|---|---|---|---|
| 8,966,835 | B1 | 3/2015 | Hoffman et al. | |
| 9,027,308 | B2 | 5/2015 | Kufner et al. | |
| D734,119 | S * | 7/2015 | Kufner | D8/105 |
| 9,279,259 | B1 | 3/2016 | Russo | |
| 9,470,002 | B2 | 10/2016 | Irvine et al. | |
| 9,482,019 | B2 | 11/2016 | Fontana | |
| 9,657,485 | B2 | 5/2017 | Meyers | |
| 10,465,394 | B2 | 11/2019 | Sighinolfi | |
| 10,577,813 | B2 | 3/2020 | Dahill | |
| 10,604,945 | B2 | 3/2020 | Volponi et al. | |
| 10,704,275 | B2 | 7/2020 | Bunch et al. | |
| 10,724,254 | B1 | 7/2020 | Troxell | |
| 10,822,813 | B1 * | 11/2020 | Bunch | E04F 21/0092 |
| 11,105,102 | B2 | 8/2021 | Bunch et al. | |
| 2013/0255182 | A1 * | 10/2013 | Kufner | E04F 21/0092 52/749.11 |
| 2014/0360130 | A1 * | 12/2014 | Kufner | E04F 21/22 52/749.11 |
| 2018/0355623 | A1 | 12/2018 | Frisco | |

OTHER PUBLICATIONS

MLT Mechanical Lippage Tuning System, https://www.mltsystem.it/en/ (last accessed May 25, 2022).

YouTube, "Spin Doctor Tile Leveling System: Wall & Floor Installation," https://www.youtube.com/watch?v=NwP1OW1-7L0 (last accessed May 25, 2022).

YouTube, "QEP's LASH Tile Leveling System | The Home Depot," https://www.youtube.com/watch?v=PUBAnbAm3AI (last accessed May 25, 2022).

YouTube, "Tuscan SeamClip Tile Leveling System by Pearl," https://www.youtube.com/watch?v=J-_Ngy8AyxE (last accessed May 25, 2022).

YouTube, "How to use Tile Leveling Clips by Peygran," https://www.youtube.com/watch?v=k90kRglqSZI (last accessed May 25, 2022).

* cited by examiner

TILE-SETTING SNAP-CLIP LIPPAGE CONTROL

BACKGROUND OF THE INVENTION

This invention provides a tile-setting snap-clip lippage control system and method for tiles set with mortar as floors or walls on prepared surfaces.

When setting tiles such as gauged porcelain tiles, panels, or slabs, or the equivalent stones or slate, lippage, or the variations in the level of the tops of the edges of the tiles after installation, is a problem of great concern. Variations of lippage or level can be visually unacceptable, as with shadows cast on walls having strong downward, upward, or side lighting. Variation of lippage or level on floors can be dangerous as tripping hazards and as areas prone to further damage by striking raised edges.

Tile installations are tending toward larger tiles and smaller grout lines, both of which can compound lippage problems. The ANSI A108.19 standard for tile installation requires a lippage control system where any dimension of the tiles is one meter or greater. The maximum allowable lippage is 1/32 inch.

Lippage control devices place compressive force on the top edges and bottom edges of adjacent tiles and force the top edges to align while accommodating variations in thickness at the bottom edges. The bottom surfaces of the tiles, including at the edges and including any lippage control device underneath the tiles, must be covered with and supported by mortar. Lippage control devices necessarily extend through the grout joint between adjacent tiles.

After the mortar has set, any parts of the lippage control device which extends up through the grout joint to the top surface of the tiles must be removed. It is undesirable to leave any scraps from the device in the grout joint, and unacceptable to leave any scraps at or near the surface of the grout. A common method for removing such parts of the lippage control device after the tiles are set is to laterally strike the parts. The striking can be done with a tool, such as a non-marking rubber mallet, but is often done with the more readily available work boot. This removal method carries a great risk of damage to the installed tile, which will frequently require cumbersome and expensive removal of damaged tile and replacement with an exactly matching tile. Many present lippage control devices either possess design features which allow the parts to become pinched or bound or blocked within the grout joint, making removal difficult and increasing the chance of damage, or features which require more cumbersome removal procedures than simply striking, sometimes requiring special tools and significant time spent on each removal.

The ANSI A108.19 standard requires that any lower part of any lippage control device which remains underneath the tiles after installation should be encapsulated with mortar. This encapsulation with mortar builds up mortar at the base of any lippage control device, and that mortar, when cured and set, can bind or block the lower parts of the device and interfere with clean removal without damage.

The smallest or thinnest grout joint allowed by the ANSI standard is 1/16" or 0.8 mm. Such a thin grout line is used in many installations. Presently known lippage control devices which have a thickness or depth in excess of 1/16" prevent installations having thinner grout lines. Although presently known lippage control devices are not necessarily designed to be used as spacers, they are often used as spacers anyway, and are likely to become pinched or bound between the tile edges, requiring excessive force, digging, or cutting to remove, increasing likelihood of damage to the installed tiles.

U.S. Pat. No. 8,966,835 for a "Reusable Shim Shell Mechanical Edge Setting System and Method for Setting Tiles and Tuning Lippage," issued on Mar. 3, 2015 to assignee New Standards Manufacturing Co., provides for a tile aligning and lippage tuning system that uses an under tile base interstitial strap, which is connected to said under tile base, and a shim shell cap configured to slip over the connecting tab. The system also comprises of a bottom tile mating shim and a top shim.

U.S. Pat. No. 9,482,019 for a "Leveling Device for Laying Tiles or the Like," issued on Nov. 1, 2016 to assignee PROFILITEC S.P.A. SOCIO UNICO, provides for a leveling device for laying tiles, or the like, which includes a tie-rod having a support base for edge portions of one or more adjacent tiles, a projecting element from the base, which can be arranged into junctions between adjacent tiles, and a knob coupling with the projecting element and having an outlet pass-through hole for a free end of the projecting element. The knob is configured to force an edge portion of the adjacent tiles against the base to level the placement and is configured to receive and retain, by snap coupling elements, a blocking tie-rod hooking and retaining the projecting element inside a pass-through channel defined in the blocking tie-rod. The blocking tie-rod is sectioned into two coupling half-shells, embracing and constraining the projecting element when inserted in the cap, and mutually separating to leave free the projecting element when at least partially extracted from the cap.

International Publication No. 2018/052331 for a "Tile-Levelling System," published on Mar. 22, 2018 by inventor Aleksandar Jelic, discloses a tile levelling system that enables the tiling of floors, walls, and ceilings so that the resulting surface is completely flat and lippage free. The system comprises a base plate with a vertical member, which has a rectangular opening perpendicular to the base plate, and two opposite longitudinal grooves, which are V-shaped in cross section, placed below the rectangular opening on the vertical member. The upper surface of the base plate is flat. The lower surface of the base plate is corrugated with parallel ridges. Between these ridges are grooves, which ensure better adhesion of either adhesive or aggregate to the very base plate, thus making the entire construction stronger.

European Patent No. 2 549 030 for a "A Device for Correct Laying of Floor Tiles," issued on Nov. 12, 2014 to assignee Brunoplast di Eleuteri Bruno, provides for a plastic device for correct laying of floor tiles, and the device comprises of a base from which a vertical blade centrally protrudes, supporting a threaded stem in upper position and being connected on the bottom with said base by means of a lower end with thinned section suitable to act as tearing line. The device also comprises of a knob, consisting in a cylindrical cover, starting from its upper closing wall, with a central cylindrical conduit with internal threaded walls, adapted to exactly receive, by means of a helical coupling, said threaded stem provided in upper position on said base.

U.S. Pat. No. 8,181,420 for a "Levelling Device for the Placing of Pieces for Covering Floors and Similar," issued on May 22, 2012 to assignee Germans Boada, S.A., provides for a device that has a first lower substantially flat body, which has in its upper part a flexible post with a narrowed or weakened portion and a second upper body with the passage for receiving and securing said post. The flexible post, which has a rectangular cross section, has in its main surfaces respective mutually opposed "teeth" which are offset in the lengthwise direction and the passage of the second body has two latching pawls mutually opposed, so that in the operative position of the devices, the teeth of the flexible post engage in an alternate form with said latching pawls. The second body has a bell like hollow form with a lower widened contact mouth or border.

U.S. Pat. No. 8,079,199 for a "Tile Alignment and Leveling Device," issued on Dec. 20, 2011 to assignee Davinci Italia/USA Group, LLC, provides for a device for aligning and leveling tiles as they are laid in floors, walls, countertops, or the like. The device has a locking assembly and a bottom plate. The components are combined with a shaft that extends from the bottom plate through the locking assembly so that the locking assembly is movable along the length of the shaft. In use, the device is placed between adjacent tiles so that the locking assembly and bottom plate hold adjacent tiles at a desired height as the setting bed dries.

U.S. Pat. No. 9,657,485 for a "Tile Leveling System," issued on May 23, 2017 to inventor Lawrence G. Meyers, provides for a tile leveling system that includes an anchor member arranged to be positioned in a setting bed below adjacent tiles. A tensioning member extends upwardly from the anchor member and is arranged to pass between the adjacent tiles. The tensioning member is made of a metallic material and frangibly connected to the anchor member via a breakage point. A loading system is arranged to be positioned on top of the adjacent tiles and includes a drive mechanism. The drive mechanism is connected to the tensioning member and is selectively operable to secure and level the adjacent tiles between the anchor member and the loading system.

U.S. Pat. No. 9,279,259 for a "Tile Lippage Removal System," issued on Mar. 8, 2016 to inventor William P. Russo, provides for a tile lippage removal system that includes a spacer post, a threaded cap, and an anti-friction protection plate. The spacer post includes a base member, a spacer member, and a threaded shaft. A bottom of the spacer member extends from a top of the base member. A break away connection is made between the spacer member and the base member. A bottom of the threaded shaft extends from a top of the spacer member. A plurality of grip extensions extends from an outer surface of a substantial inverted cup to allow rotation of the threaded cap. A female thread is formed in a center of the substantial inverted cup to threadably receive the threaded shaft. The anti-friction protection plate includes a round outer perimeter and a spacer opening, which is sized to receive the spacer member. The anti-friction protection plate may be used to improve existing tile lippage removal systems.

U.S. Pat. No. 9,470,002 for a "Tile Leveller and Spacing System," issued on Oct. 18, 2016 to assignee ME INNOVATIONS PTY LTD, provides for a tile leveller and spacer system that allows rapid and reliable spacing and levelling of tiles. The tile spacer comprises a base for locating the spacer under the tiles, and a stem that includes an alignment cross which is used to correctly space the tiles. The stem tile spacer is placed over the stem and engages with teeth on the stem. The tile leveller is pushed down over the stem to level the tiles between the base and the bottom of the tile leveller. The stem further comprises a frangible portion located between the base and the tile alignment portion, and when the stem is pulled with sufficient force, the frangible portion breaks to allow removal of the stem. A hand tool may be used to assist in this process. The hand tool can have an adjustable stop which can be set to a first setting to level the tiles, and a second setting to cause the frangible portion to break, allowing removal of the stem and leveller.

US Publication No. 2018/0355623 for a "Tile Leveling System," published on Dec. 13, 2018 by inventor Scott Frisco, discloses a tile leveling system for leveling tiles. The system has a tile lifter whose transverse member is inserted into the grout gap, and turned to get underneath adjacent tiles. The system has a reusable clamping unit, a U-shaped, possibly flexible, wedge, which is slid through the lifter's vertical shaft to sandwich the tiles between the transverse member and the wedge. The transverse member can be concave up, and the lifter can have two transverse members with spacers on each four-corner junction. The lifter's handle can have a U-shaped hole, which allows a rocker tool to be used to level tiles. Another leveling tool, called a gun tool can be used with any of the lifters. Also proposed are two simpler threaded and zip-tie systems. The leveling devices can be used as needed, thus saving the cost of using them in the entire tiled area.

U.S. Pat. No. 8,429,878 for a "System and Method for Aligning and Leveling Tile," issued on Apr. 30, 2013 to assignee New Standards Manufacturing Co., provides for a tile aligning and leveling system that uses an under tile base, a re-usable upright connecting tab, which is detachably connected to said under tile base, a re-usable flexible edge slotted cap configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

U.S. Pat. No. 8,820,031 for a "Tile Alignment and Leveling Device," issued on Sep. 2, 2014 to assignee Davinci Italia/USA Group, LLC, provides for a tile alignment and leveling device for aligning and leveling tiles as they are being secured to a substrate. The device includes a flexible member, a bottom plate, and an intermediate member. The intermediate member spaces the flexible member and bottom plate a predetermined vertical distance. The flexible member has a first end and a second end. The first end is pivotally combined with the intermediate member thereby allowing the flexible member to pivot between a first position and a second (downward) position. In use and in its second position, the flexible member second end exerts force against the top of the tiles to help align and level the tiles as they are secured to the substrate.

SUMMARY OF THE INVENTION

This invention provides a tile-setting snap-clip lippage control system and method for tiles set with mortar as floors or walls on prepared surfaces.

The tile-setting snap-clip lippage control system provides tab-and-clip pairs with a footed tab lower unit having a footplate connected by a bending neck, a multi-tapered descending portion having a thicker center, tapering base, tapering sides, and a clip mount, and a snap clip upper unit for removable attachment to the footed tab through a tab mount, having a clip body with snap posts and clip ledges, and having two snap flaps mounted through flap hinges, each with a snap hole to engage with a snap post, a flap ledge to engage with a clip ledge, and a flap tooth to engage with the underside of a flap hinge.

Two adjacent tiles are held with compressive force between the footplate and one of the snap flaps during curing of the mortar. The footed tab is then removed by lateral striking, shearing at the bending neck, leaving only the encapsulated footplate.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
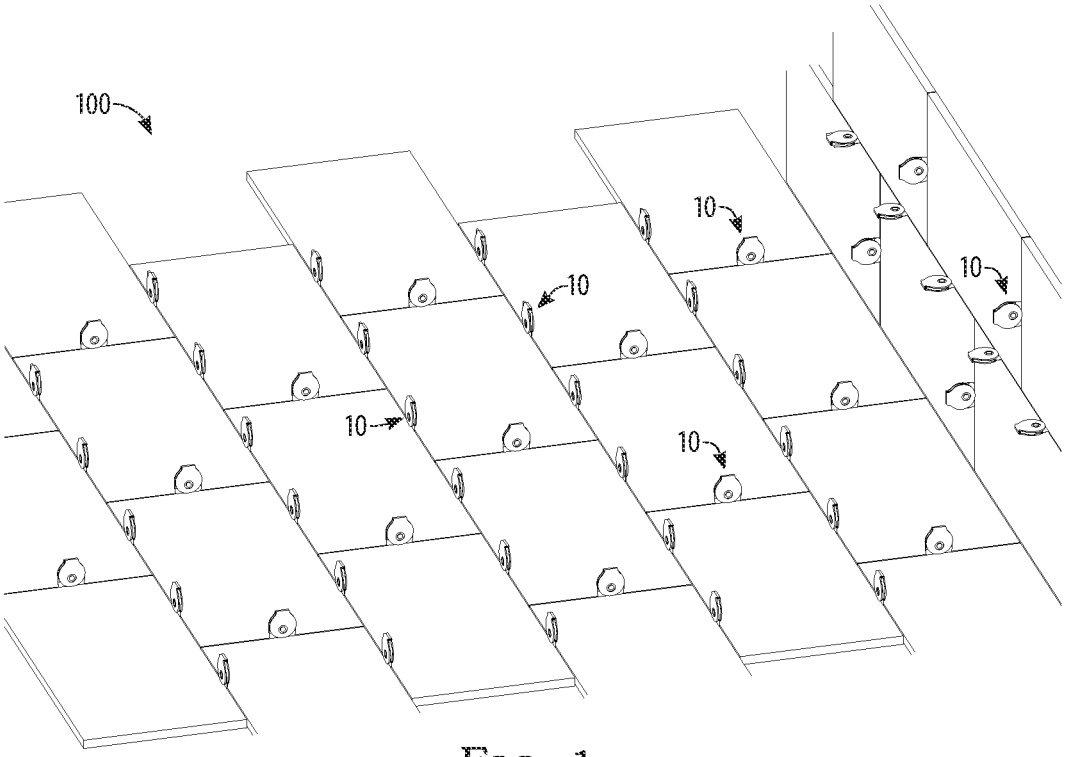
FIG. 1 is a schematic view of the tile-setting snap-clip lippage control system and method of the invention in use on tile set on a horizontal and a vertical surface.

Referring to FIG. 1, the tile-setting snap-clip lippage control system and method 100 provides tab-and-clip pairs 10 for use with tiles set with mortar as floors or walls on prepared surfaces. Usually, gauged tiles or panels or slabs are used and are set with thinset mortar. Usually, a very thin grout line is used, with 1/16" or 0.8 mm being the thinnest allowed by ANSI A108.19.

Figure 2:
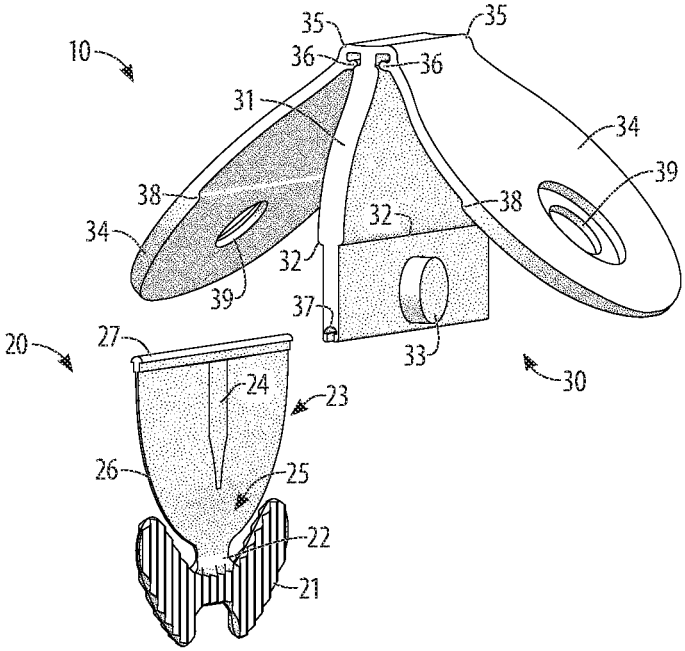
FIG. 2 is a perspective view of the tab-and-clip pair of the tile-setting snap-clip lippage control system of the invention.

Referring to FIG. 2, each tab-and-clip pair 10 in turn provides a footed tab 20 and a snap clip 30. The footed tab 20 has a top-to-bottom orientation in relation to the tiles to be set, with a footplate 21 at the bottom, meant to fit underneath the bottoms of the tiles, and with a top portion extending above the top surfaces of the tiles, with sides extending along the grout line where the tiles join, and with tab faces substantially parallel to the tile edges, with one face toward one tile and the other face toward the other tile. For horizontal setting of tiles on a floor, the top-to-bottom orientation corresponds to normal up and down directions. For vertical or angled setting of tiles on a wall or other non-horizontal prepared surface, the top-to-bottom orientation corresponds to a line perpendicular to that non-horizontal surface. The footed tab 20 provides a clip mount 27 at the top, for the removable mounting of the snap clip 30, as treated below.

The snap clip 30 provides a clip body 31 having a top-to-bottom orientation corresponding to the top-to-bottom orientation of the footed tab 20. The clip body 31 provides a tab mount 37 at the bottom, meant for removable mounting to the clip mount 27 of the footed tab 20. In the illustrated embodiment, the mounting is affected by sliding the tab mount 37 onto the clip mount 27, with removal by sliding the tab mount 37 off of the clip mount 27. In use, the clip body 31 will exert a strong upward force through the footed tab 20 to the footplate 21, and the mounting of the clip body 31 to the footed tab 20 must be able to accommodate the force without loosening during the curing of the mortar. The design of the tab-and-clip pair 10 and the materials used should provide the strength necessary to accommodate the forces used, but not incorporate structures or materials which could damage the installed tiles during installation, curing, or removal, even when used improperly or when accidentally kicked, or struck, or rolled over. The footed tab 20 and the snap clip 30 can be made of plastic material, including recycled plastic material. High-density polyethylene (HDPE) is a suitable material which is inherently non-marring, which can be beneficial in preventing damage from improper use or accidental pressure, striking, or kicking.

As will be treated in detail below, during use, the footed tab 20 is placed between two tiles with the footplate 21 underneath the tiles, the snap clip 30 is mounted to the footed tab 20, and two snap flaps 34 are folded down and snapped against the clip body 31 of the snap clip 30, causing the lower extreme ends of the snap flaps 34 to contact and exert force against the tops of the tiles while the footplate 21 exerts force against the bottoms of the tiles. Control of the amount of force and the stability of the force during the curing of the mortar is improved by this invention as treated in detail below.

Figure 3:
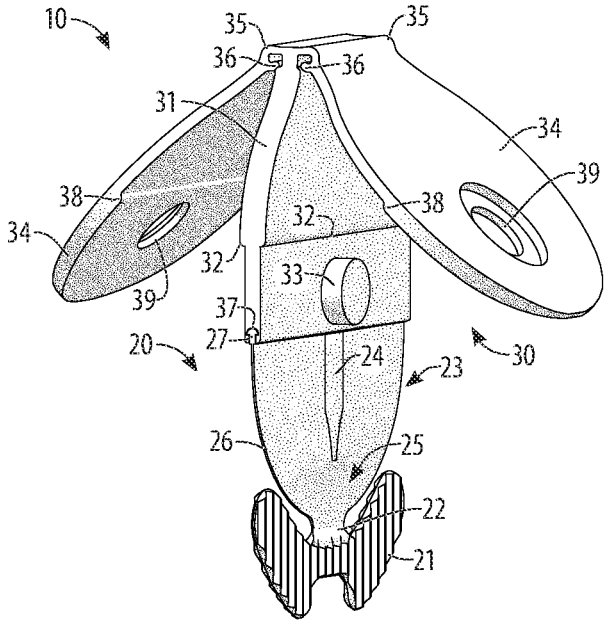
FIG. 3 is a perspective view of the tab-and-clip pair of the tile-setting snap-clip lippage control system of the invention with snap flaps up.
Figure 4:
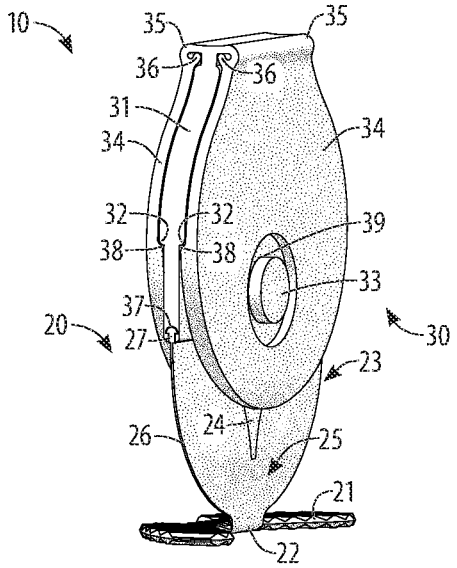
FIG. 4 is a perspective view of the tab-and-clip pair of the tile-setting snap-clip lippage control system of the invention with snap flaps down.

Referring additionally to FIG. 3 and FIG. 4, the footplate 21 is connected at the bottom of the footed tab 20 by a bending neck 22 of narrowed and thinned material which provides a preferential point for the footed tab 20 to later be torn away from the footplate 21 which remains embedded in mortar below the tiles after installation, as treated below. The bending neck 22 is strong enough to withstand the substantially straight-line force applied during use, as treated below, but will preferentially fail when a lateral or oblique force is applied for the purpose of removal. The footplate 21 has a double-forked footprint to allow for areas of direct mortar joining of the bottom of the tiles to the prepared surface, encapsulating the footplate 21. The footplate 21 also has a large number of ridges to allow the flow of mortar and further encapsulation of the footplate 21 by the mortar, further avoiding voids in the mortar at the footed tab 20, ensuring a stable setting and preventing later damage to the tiles at the site of the footplate 21, which remains underneath the tiles after the tiles are set.

The main portion of the footed tab 20 is the multi-tapered descending portion 23 descending from the clip mount 27 at the top to the bending neck 22 and footplate 21 at the bottom. The multi-tapered descending portion 23 of the footed tab 20 extends in use from substantially just above the level of the thickest tiles anticipated, down through the grout joint to the footplate 21. A thicker center 24 is provided, where the thickness or depth of the multi-tapered descending portion 23 is at a maximum, with thinning toward the sides. The multi-tapered descending portion 23 tapers in width from widest at the upper extreme to narrowest at the lowest extreme. The multi-tapered descending portion 23 also tapers in depth or thickness from a maximum thickness at the thicker center 24 down to a minimum depth or thickness at the edge of each tapering side 26. The multi-tapered descending portion 23 also tapers in depth or thickness in the tapering base 25 portion from a greater thickness at the upper portion to a minimum thickness at the lowest portion where the tapering base 25 portion is joined by the bending neck 22 to the footplate 21.

When the footed tab 20 is used as a spacer in addition to its use for lippage control, the thicker center 24 sets the spacing, while the thinning toward the edges prevents the tile edges from exerting a pinching force on the entire multi-tapered descending portion 23. The tapering of the multi-tapered descending portion 23 leaves a significant amount of void space in the grout joint. The lower portions of that void space can accommodate the mortar required for complete encapsulation of the footplate 21, without causing any binding or blocking obstructing later removal of the footed tab 20. When used as a spacer, a thickness that is from 1/32 to 1/64 inch thicker than the actual finished size of the grout joint is appropriate. For example, a maximum thickness of 3/32 inch would be used to obtain a true 1/16 inch grout joint.

Even when not used as a spacer, the thicker center 24 with thinning toward the edges and toward the top of footed tab (as per drawing) prevents cured mortar from being trapped within the multi-tapered descending portion 23 and creating an impediment to clean removal. The tapering base 25 of the multi-tapered descending portion 23 thins toward its area of joining with the bending neck 22 and footplate 21. This thinning prevents cured mortar from being trapped by anything other than the footplate 21 itself, which is intended to be encapsulated by mortar and be torn away to remain underneath the installed tiles.

The tapering sides 25 of the multi-tapered descending portion 23 of the footed tab 20 taper from the full width of the footed tab 20 at a higher level to a reduced width at the bottom where the footplate 21 is joined through the bending neck 22 to the footed tab 20. This tapering reduction in width can be a curved tapering, as illustrated, or can be a more angled or segmented tapering.

The three-dimensional structure of the multi-tapered descending portion 23 has the property that at any point along the tapering side 26, any adjacent point toward the center will be thicker and therefore stronger, and any adjacent point away from the center will be thinner and therefore weaker. Therefore, if any point toward any edge of the multi-tapered descending portion 23 becomes embedded in cured mortar, the adjacent points toward the center will be thicker and therefore stronger, and also therefore will have occupied the space and prevented any mortar from surrounding and blocking in or trapping the first point. And therefore, when pulling the multi-tapered descending portion 23 out of the cured mortar, at any given point, the adjacent points toward the center will be thicker and stronger and will pull the thinner weaker given point along, and the given point will be pulled into the void space formerly occupied by the thicker adjacent points and not be pulled into any blocking or trapping cured mortar. This ease-of-removal property is enhanced by forming the footed tab 20 from a material with an inherent resistance to bonding to the mortar, such as HDPE, disclosed above.

The snap clip 30 also provides two snap flaps 34 each connected at the top of the clip body 31 by a flap hinge 35 in a side-to-side orientation parallel to the tile edges and the clip mount 27 and tab mount 37. The lower portion of each snap flap 34, opposite the flap hinge 35, is of a curved or rounded partial-circle or partial-oval shape having a decreasing amount of material approaching the extreme end. The decreased amount of material allows the extreme end of the snap flap 34 to become resiliently deformed when forced against the top of a tile, with the increasing amount of material away from the extreme end providing increasing resistance to deformation. The thickness of the material toward the extreme end of the snap flap 34 can also be decreased, as illustrated, for the same reason of providing for resilient deformation when forced against the tile. The upper portions of the snap flaps 34 and of the clip body 31 can also be rounded, as illustrated, for the purpose of saving material where excess material is not needed.

The clip body 31 also provides two snap posts 33, each opposite the other, and each snap flap 34 provides a corresponding snap hole 39. The snap posts 33 and snap holes 39 are located in the lower portion of the snap clip 30, and therefore closer to the extreme end of the snap flap 34 and farther from the flap hinge 35. In use, as treated in detail below, the snap flaps 34 are folded down and snapped against the clip body 31, holding the snap flaps 34 securely against the clip body 31. In this position, additional structures of the snap clip 30 are brought into use. The clip body 31 also provides two clip ledges 32, each on an opposite side, where the thickness of the clip body 31 steps from a greater thickness at a higher portion to a lesser thickness at a lower portion. The location of the clip ledges 32 are toward the lower middle portion of the clip body 31, above the snap posts 33. Each snap flap 34 provides a flap ledge 38 corresponding to a clip ledge 32, where the thickness of the snap flap 34 steps from a lesser thickness at a higher portion to a greater thickness at a lower portion, such that when the snap flap 34 is folded and snapped against the clip body 31 the flap ledge 38 fits against the clip ledge 32. Each snap flap 34 also provides a flap tooth 36, which is a protrusion of material near the flap hinge 35 at the top of the snap clip 30. Before the snap flap 34 is folded and snapped against the clip body 31 the flap tooth 36 does not exert any force against the bottom of the flap hinge 35 area, and when the snap flap 34 is folded and snapped against the clip body 31 the flap tooth 36 contacts the bottom of the flap hinge 35 area and can exert a counterforce against a force tending to push the snap flap 34 upward.

Figure 5:
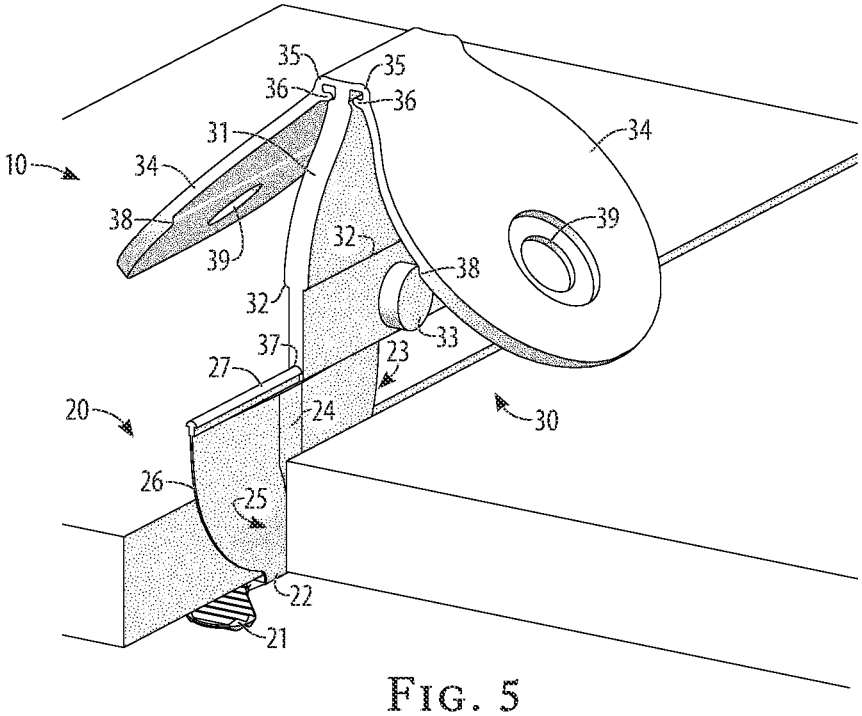
FIG. 5 is a perspective view of the tab-and-clip pair of the tile-setting snap-clip lippage control system of the invention in use during installation.
Figure 6:
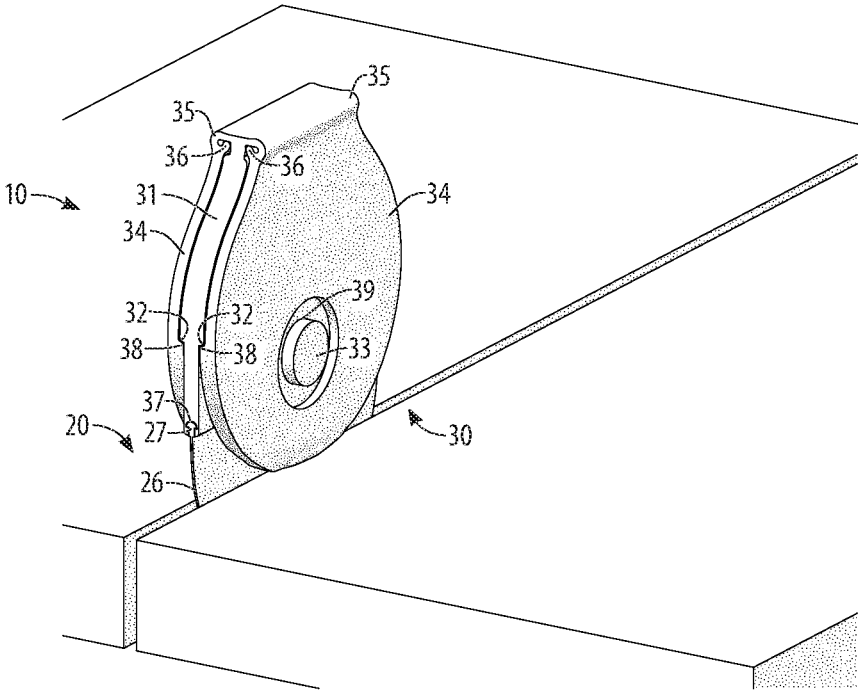
FIG. 6 is a perspective view of the tab-and-clip pair of the tile-setting snap-clip lippage control system of the invention in use after installation.

Referring to FIG. 5 and FIG. 6, in use, with mortar having been applied to the subfloor, the footed tab 20 is placed between two tiles, with the footplate 21 bent at the bending neck 22 and with the footplate 21 located beneath both tiles, embedded in the mortar. The multi-tapered descending portion 23 sits within the grout line between the two tiles. If the footed tab 20 is also being used as a spacer, the tiles are brought into contact with the thicker center 24 of the footed tab 20. Then the snap clip 30 is removably mounted to the footed tab 20 by sliding the tab mount 37 over the clip mount 27 so that the snap clip 30 is mounted above the footed tab 20. Then the snap flaps 34 are folded down and the snap holes 39 are snapped over the snap posts 33. The tiles are compressed between the snap flaps 34 and the footplate 21. If the tiles are of slightly different thickness then the footplate 21 can pivot at the bending neck 22 to accommodate the difference, leaving the tops of the tile level with each other. The downward extreme ends of the snap flaps 34 press against the tops of the tiles and resiliently deform against the tops of the tiles. The force from the tops of the tiles presses the lower portion of the snap holes 39 against the snap posts 33, which reinforces the closure of the snap, and the snap post 33 provides bracing against upward movement of the snap flap 34 and therefore loosening of the compressive force against the tiles. The force from the tops of the tiles also presses the flap ledges 38 against the clip ledges 32, providing further bracing against upward movement of the snap flap 34 and therefore loosening of the compressive force against the tiles. The flap tooth 36 near the top of the snap clip 30 just beneath the flap hinge 35 comes into contact with the underside of the flap hinge 35 when the snap flap 34 is folded down, providing further bracing against upward movement of the snap flap 34 and therefore loosening of the compressive force against the tiles. The flexible flap hinge 35 might otherwise allow upward movement of the snap flap 34, but such movement is braced against at the snap post 33 and snap hole 39, at the clip ledge 32 and flap ledge 38, and at the flap tooth 36. Also, as treated above, the mounting of the snap clip 30 to the footed tab 20 through the clip mount 27 and tab mount 37 provides further bracing against unwanted upward movement of the clip body 31 which might negate the benefits of bracing the snap flaps 34 against the clip body 31.

Figure 7:
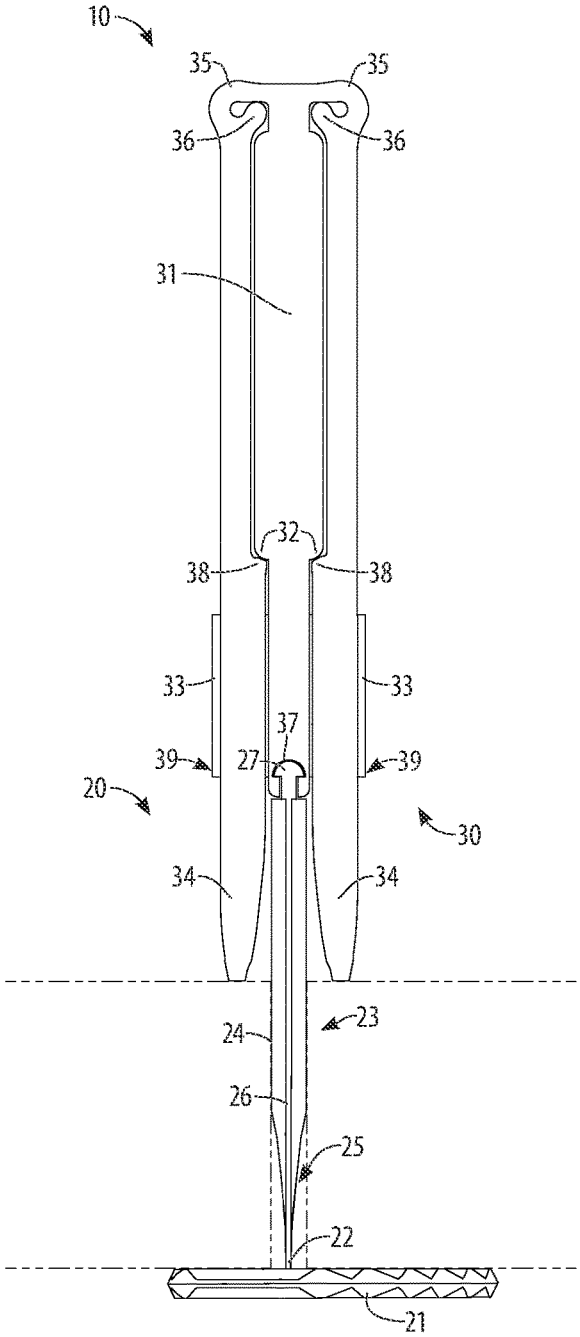
FIG. 7 is a side view of the tab-and-clip pair of the tile-setting snap-clip lippage control system of the invention in use with thinner tile.
Figure 8:
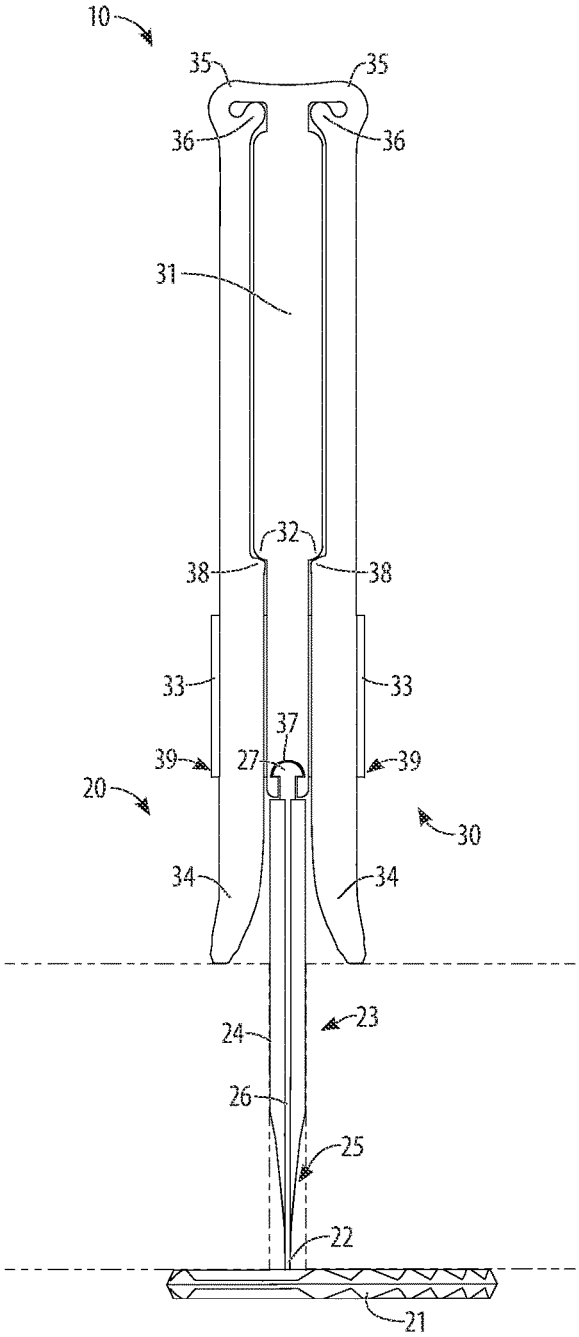
FIG. 8 is a side view of the tab-and-clip pair of the tile-setting snap-clip lippage control system of the invention in use with thicker tile.

Referring to FIG. 7 and FIG. 8, the tab-and-clip pair 10 can be used with different thicknesses of tile because the downward extreme ends of the snap flaps 34, which contain less material because the side-to-side profile of the ends are smaller and because the ends can be made less thick, can be resiliently deformed different amounts to conform to different thicknesses of tile. As illustrated, with a thinner tile the ends of the snap flaps 34 will deform less, with most of the deformation being a vertical bunching of the material, and with a thicker tile the ends of the snap flaps 34 will deform more, and some of the deformation can be a horizontal deflection of the material. Also illustrated are the secure removable mounting of the clip body 31 to the footed tab 20 through the tab mount 37 and clip mount 27, and the bracing of the snap flaps 34 against the clip body 31 at the snap post 33 and snap hole 39, the clip ledge 32 and flap ledge 38, and the flap tooth 36.

The tab-and-clip pair 10 is left in place until the mortar has cured and set. The tab-and-clip pair 10 can then be removed. The snap clip 30 can be removed before the footed tab 20 is removed by striking, or the snap clip 30 can be left in place, which is likely to happen occasionally no matter what instructions are given.

Figure 9:
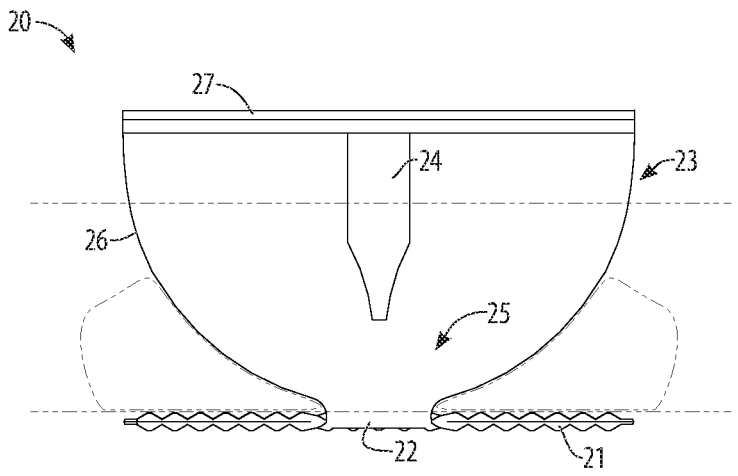
FIG. 9 is a front view of the footed tab of the tile-setting snap-clip lippage control system of the invention in use set in mortar before removal.
Figure 10:
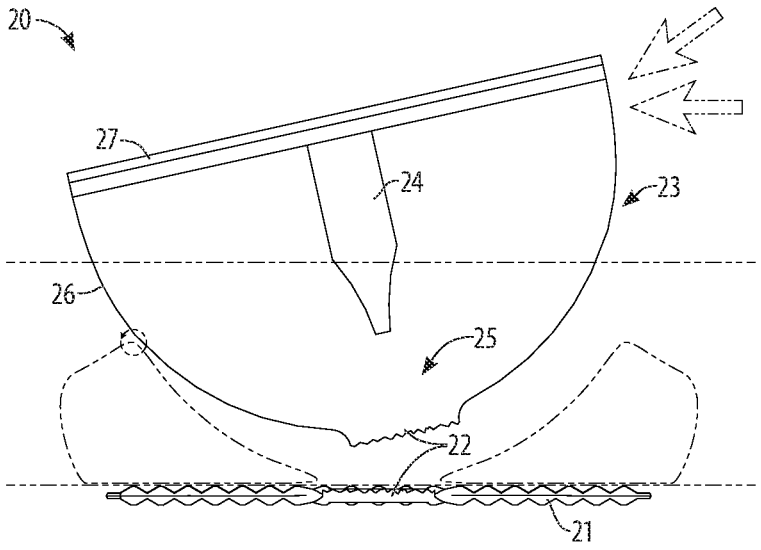
FIG. 10 is a front view of the footed tab of the tile-setting snap-clip lippage control system of the invention in use during removal.

Referring to FIG. 9 and FIG. 10, the top portion of the footed tab 20 extends above the tile surface in use, and provides a stable structure for the mounting of the snap clip 30, for the exertion of compressive force against the tiles, and for eventual removal of the footed tab 20 by a lateral striking motion. The shape of the multi-tapered descending portion 23 of the footed tab 20 ensures that no part of the footed tab 20, other than the footplate 21 which is intended to be torn away and left underneath the tiles, will be blocked or impeded from removal from cured mortar, because every area of the multi-tapered descending portion 23 is either narrower or thinner, or both, than any area more toward the thicker center 24, with no protrusions, peaks, valleys, or cups capable of being blocked by cured mortar. As illustrated, after curing, and usually after removal of the snap clip 30 which is capable of being re-used multiple times, the footed tab 20 will remain in the grout joint between the tiles with at least the footplate 21 being completely encapsulated in cured mortar in accord with the ANSI A108.19 standard. It is possible that excess cured mortar will also surround the multi-tapered descending portion 23, presenting a possible impediment to removal of the footed tab 20 without damaging the installed tile. But the configuration of the multi-tapered descending portion 23 allows removal without any part of the footed tab 20, except for the footplate 21, being bound or blocked by cured mortar and requiring excessive force to remove. Even if excess cured mortar is built up around the multi-tapered descending portion 23, the tapering side 26 where it contacts the high point of the mortar will act as a fulcrum for leverage to rock or to roll out of the grout joint by a pivoting or rolling movement. The opposite tapering side 26 will lift and pull away from the cured mortar without encountering any further binding or blocking. The bending neck 22 is made narrow and thin, with enough strength to accommodate the straight-line force necessary to compress the tiles between the snap clip 30 and the footplate 21 without stretching or shearing, but weak enough to preferentially shear or rip upon the application of lateral or oblique force, such as from striking with a mallet or from kicking.

Because the multi-tapered descending portion 23 of the footed tab 20 cannot be blocked or trapped by cured mortar, there will not be any need to dig or cut any blocked or trapped part of the footed tab 20 from the grout joint. The clean and simple removal of the footed tab 20 after the mortar has set, which does not leave plastic residue in the grout joint requiring additional attention, greatly reduces the risk of damaging the installed tiles, which would require expensive remedial action by the installer in order to properly complete the installation job. The configuration of the footplate 21, with a double-forked footprint and large number of ridges, and with only the bending neck 22 for tearing away from the tapering base 25, which is otherwise surrounded by mortar filling the former void spaces, allows and promotes the full encapsulation of the footplate 21 required by the ANSI standard, which in turn allows and promotes a solid and stable tile installation which will not develop problems over time.

The footed tab 20 less the footplate 21 can be easily and safely removed intentionally, and also provides protection against damage to the installed tile resulting from accidents or improper treatment, because any lateral or oblique striking of the footed tab 20 with or without the snap clip 30 mounted should result in shearing at the bending neck 22 removing or allowing the removal of the footed tab 20. And the tab-and-clip pair 10 is preferably manufactured from a non-marring material such as HDPE which is unlikely to damage the tile.

Both the footed tab 20 and the snap clip 30 can be made of recycled and recyclable plastic material. After removal, the footed tab 20 less the footplate 21 cannot be re-used for its original primary purpose, but can be re-used for its secondary purpose as a spacer for setting the width of the grout joint. When used as a spacer, the multi-tapered descending portion 23 of the used footed tab 20 still prevents any binding by cured grout and still provides easy removal and protection against damage by accident or misuse. The snap clip 30 is not permanently altered or damaged during normal use, and can be re-used for later installations using new footed tabs 20.

Although the normal tab-and-clip pair 10 can accommodate a range of tile thicknesses as treated above, more extreme variations of tile thickness could be accommodated with different footed tabs 20 having different vertical sizes. Also, because the thickness of the thicker center 24 is a set value, different footed tabs 20 having other set thicknesses could serve as different-sized spacers.

Many other changes and modifications can be made in the system and method of the present invention without departing from the spirit thereof. We therefore pray that our rights to the present invention be limited only by the scope of the appended claims.

We claim:

1. A tile-setting snap-clip lippage control system for use with tiles set with mortar as floors or walls on prepared surfaces, the tile-setting snap-clip lippage control system comprising:

(i) a footed tab having a top-to-bottom orientation in relation to the tiles, a side-to-side width along the tile edges, and tab faces substantially parallel to tile edges;

(ii) a footplate mounted at the bottom of said footed tab by a bending neck, adapted to allow encapsulation with mortar in use, and adapted to apply compressive force to the bottom of tile in use, where said bending neck is adapted to preferentially shear upon the application of lateral force;

(iii) a multi-tapered descending portion at the bottom of said footed tab having on each tab face a thicker center tapering toward the sides, a tapering base thinning toward said footplate, and tapering sides of reducing width toward the bottom;

(iv) a clip mount mounted at the top of said footed tab;

(v) a snap clip having the same top-to-bottom, side-to-side orientation of said footed tab, and having a clip body;

(vi) a tab mount mounted at the bottom of said clip body, adapted to removably mount to said clip mount;

(vii) two clip ledges formed in said clip body;

(viii) two snap posts formed on said clip body;

(ix) two snap flaps, each mounted at the top of said clip body through a flap hinge, adapted to apply compressive force to the top of tile in use;

(x) a snap hole formed in each said snap flap, adapted to fit over a said snap post and to exert bracing force against said snap post when said snap flap is folded down;

(xi) a flap tooth formed on each said snap flap adjacent to said flap hinge, adapted to exert bracing force against said flap hinge when said snap flap is folded down; and (xii) a flap ledge formed on each said snap flap, adapted to engage and exert bracing force to a said clip ledge when said snap flap is folded down.

2. The tile-setting snap-clip lippage control system of claim 1, where said footed tab further comprises a tile spacer.

3. The tile-setting snap-clip lippage control system of claim 1, where said tapering sides taper in a curve.

4. The tile-setting snap-clip lippage control system of claim 1, where said tapering sides taper in angled steps.

5. The tile-setting snap-clip lippage control system of claim 1, where said tapering sides taper in a straight line.

6. The tile-setting snap-clip lippage control system of claim 1, where said footed tab is made of a recyclable plastic material.

7. The tile-setting snap-clip lippage control system of claim 1, where said footed tab is made of high-density polyethelene.

8. The tile-setting snap-clip lippage control system of claim 1, where said snap clip is made of a recyclable plastic material.

9. The tile-setting snap-clip lippage control system of claim 1, where said snap clip is made of high-density polyethelene.

10. The tile-setting snap-clip lippage control system of claim 1, where said footplate further comprises a double-forked footprint.

11. The tile-setting snap-clip lippage control system of claim 1, where said footplate further comprises ridges.

12. The tile-setting snap-clip lippage control system of claim 1, where said footplate is further adapted to adjust for variations in tile thickness at the bottom of the tiles.

13. The tile-setting snap-clip lippage control system of claim 1, further adapted for re-use of said snap clip in later tile installations.

14. The tile-setting snap-clip lippage control system of claim 1, further adapted for re-use of said footed tab as a tile spacer.

15. A tile-setting snap-clip lippage control method comprising:

(i) providing a tile-setting snap-clip lippage control system comprising:

(a) a footed tab having a top-to-bottom orientation in relation to the tiles, a side-to-side width along the tile edges, and tab faces substantially parallel to tile edges;

(b) a footplate mounted at the bottom of said footed tab by a bending neck, adapted to allow encapsulation with mortar in use, and adapted to apply compressive force to the bottom of tile in use, where said bending neck is adapted to preferentially shear upon the application of lateral force;

(c) a multi-tapered descending portion at the bottom of said footed tab having on each tab face a thicker center tapering toward the sides, a tapering base thinning toward said footplate, and tapering sides of reducing width toward the bottom;

(d) a clip mount mounted at the top of said footed tab;

(e) a snap clip having the same top-to-bottom, side-to-side orientation of said footed tab, and having a clip body;

(f) a tab mount mounted at the bottom of said clip body, adapted to removably mount to said clip mount;

(g) two clip ledges formed in said clip body;

(h) two snap posts formed on said clip body;

(i) two snap flaps, each mounted at the top of said clip body through a flap hinge, adapted to apply compressive force to the top of tile in use;

(j) a snap hole formed in each said snap flap, adapted to fit over a said snap post and to exert bracing force against said snap post when said snap flap is folded down;

(k) a flap tooth formed on each said snap flap adjacent to said flap hinge, adapted to exert bracing force against said flap hinge when said snap flap is folded down; and (l) a flap ledge formed on each said snap flap, adapted to engage and exert bracing force to a said clip ledge when said snap flap is folded down;

(ii) applying mortar to the prepared surface;

(iii) placing said footed tab between two adjacent tiles, with said footplate underneath both tiles, and with said multi-tapered descending portion extending upward through the grout joint;

(iv) mounting said snap clip upon said footed tab;

(v) folding said snap flaps down;

(vi) engaging said snap holes with said snap posts;

(vii) deforming said snap flaps against the top of the tiles, thereby applying compressive force to the tiles between said snap flaps and said footplate;

(viii) allowing curing and setting of the mortar;

(ix) removing said footed tab from the grout joint by lateral striking, thereby shearing said bending neck;

(x) leaving said footplate under the tiles, encapsulated in mortar, and (xi) grouting the grout joint.

* * * * *